US006104997A

United States Patent [19]

Shuholm

[11] Patent Number: 6,104,997

[45] Date of Patent: Aug. 15, 2000

[54] DIGITAL AUDIO RECEIVER WITH MULTI-CHANNEL SWAPPING

[75] Inventor: Kevin J. Shuholm, Grass Valley, Calif.

[73] Assignee: Grass Valley Group, Nevada City, Calif.

[21] Appl. No.: 09/064,805

[22] Filed: Apr. 22, 1998

[51] Int. Cl.[7] ..... H04K 1/10

[52] U.S. Cl. ..... 704/500; 375/260

[58] Field of Search ..... 375/260, 335, 375/359, 328; 704/500

[56] References Cited

U.S. PATENT DOCUMENTS 5,524,054 6/1996 Spille ..... 381/18

5,646,931 7/1997 Terasaki ..... 369/124

5,923,710 7/1999 Shuholm et al. ..... 375/260

*Primary Examiner*—David R. Hudspeth

*Assistant Examiner*—Daniel Abebe

*Attorney, Agent, or Firm*—Kenyon & Kenyon

[57] ABSTRACT

A digital audio receiver with multi-channel swapping capabilities receives as inputs at least two AES serial digital audio streams. The audio streams are decoded, and each audio channel is stored in a separate buffer. The outputs of the buffers are input to at least two selectors. The selectors under user control select for each output digital audio stream which channels are represented. The recombined digital audio streams are then input to a conventional router cross-point matrix for directing to a desired destination and formatted into new AES serial digital audio streams.

9 Claims, 2 Drawing Sheets

DIGITAL AUDIO RECEIVER WITH MULTI-CHANNEL SWAPPING

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention relates to audio routing, and more particularly to a digital audio receiver with multi-channel swapping capabilities.

An internationally known standard for the interchange of digital audio is AES3-1992. Under this standard two channels of audio are digitized and then time multiplexed into a single serial digital data stream. This stream contains certain synchronizing symbols, known as preambles, that are used by a receiver of the stream to demultiplex and deserialize the two digital audio channels. Often a device, such as a video tape recorder (VTR), has two AES streams representing four channels of audio. The first stream is generally referred to as AES1/2 and the other stream as AES3/4.

In a broadcast facility a user may connect these signals to the input of a router so that particular sources may be selected for particular destinations. A typical installation may have one portion of the router that deals only with AES1/2 signals on the inputs and outputs and another portion that deals only with AES3/4 signals on the inputs and outputs, as shown in FIG. 1. The user also may want to do "channel swapping"—connecting an AES1/2 source to an AES3/4 destination. To do this the number of crosspoints in the matrix are doubled, as shown in FIG. 2.

A new problem arises when a source is entering an installation and the audio channels, or samples, are not in the right place in the stream. In such a situation the user may wish to swap channels 1 and 3, leaving channels 2 and 4 where they are. In other words the desired output streams of the router for this source are AES3/2 and AES1/4. This requires manipulation of the data stream. Currently this problem may be solved using hardware external to the router, such as some sort of digital audio mixing module. This requires more rack space in the installation as well as a separate means of control.

An existing synchronous digital audio receiver, as shown in FIG. 3, works by having an AES decoder extract clock and audio data information from an AES stream. The extracted clock is used to write the audio data to a first-in/first-out (FIFO) buffer. A system clock is used to read the data from the FIFO. From there the digital data goes to a crosspoint switch and then to an output formatter, the output formatter reassembling the data into an AES stream. The system may use a single FIFO for storing both left and right samples or a separate FIFO for each set of samples. For an example of the use of such receivers refer to U.S. patent application Ser. No. 08/795,213, filed Feb. 5, 1997 by Shuholm et al entitled "Synchronous Switching of Digital Audio While Maintaining Block Alignment."

What is desired is a digital audio receiver with multi-channel swapping capabilities at the input of a router that provides "true channel swapping".

BRIEF SUMMARY OF THE INVENTION

Accordingly the present invention provides a digital audio receiver with multi-channel swapping capabilities that decodes at least two AES streams and stores each channel audio data in a separate FIFO. The channel audio data from the FIFOs are input to at least two selectors that provide at the output at least two new audio data streams having a desired combination of the channel audio data. The two new audio data streams are input to a conventional router for directing to desired destinations and formatting as AES streams.

The objects, advantages and other novel features of the present invention are apparent from the following detailed description when read in conjunction with the appended claims and attached drawing.

DETAILED DESCRIPTION OF THE INVENTION

Figure 1:
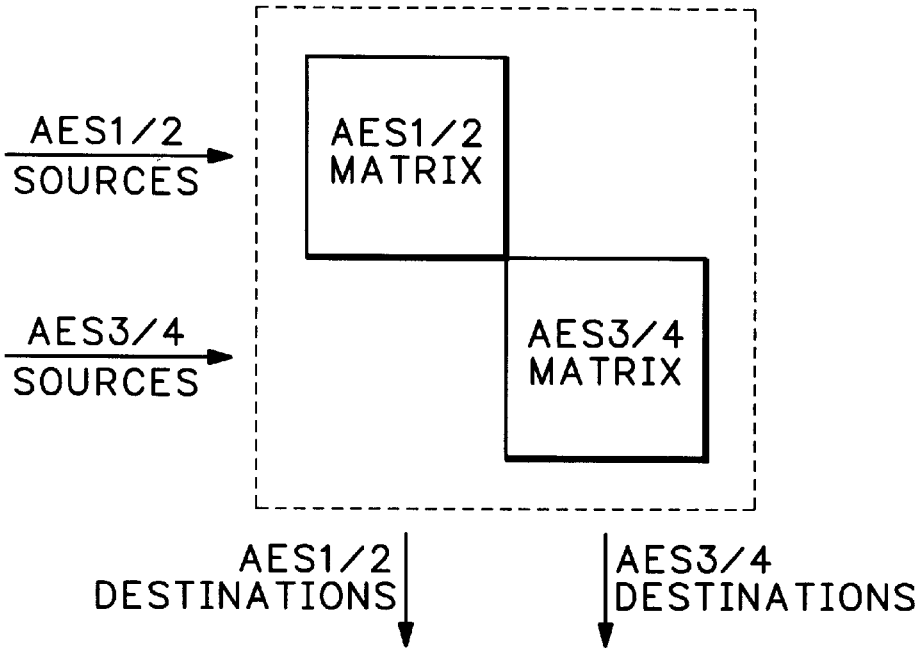
FIG.1 (PRIOR ART)
FIG. 1 is a conceptual block diagram view of a prior art router for audio signals.
Figure 2:
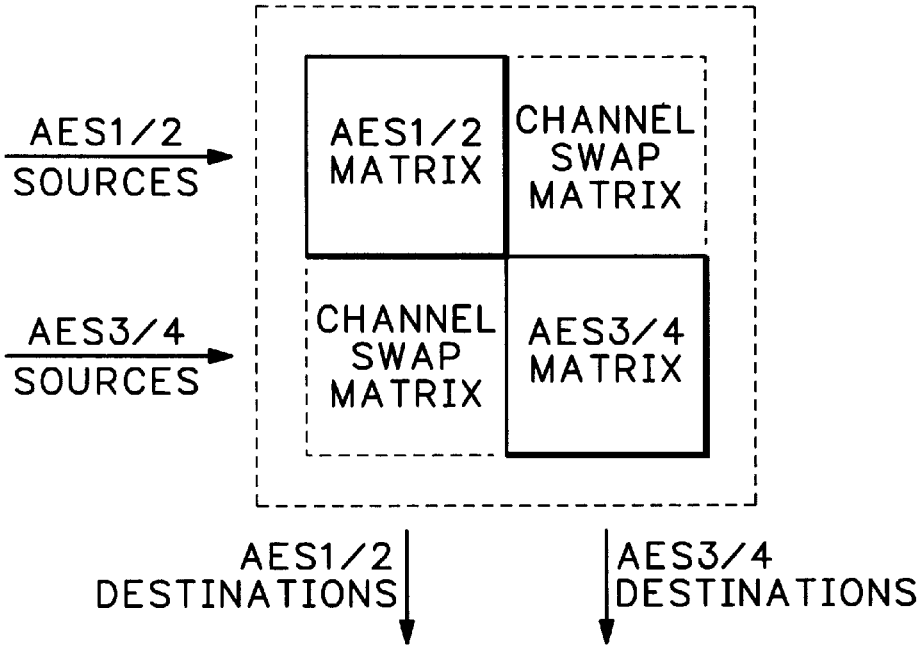
FIG.2 (PRIOR ART)
FIG. 2 is a conceptual block diagram view of another prior art router for audio signals.
Figure 3:
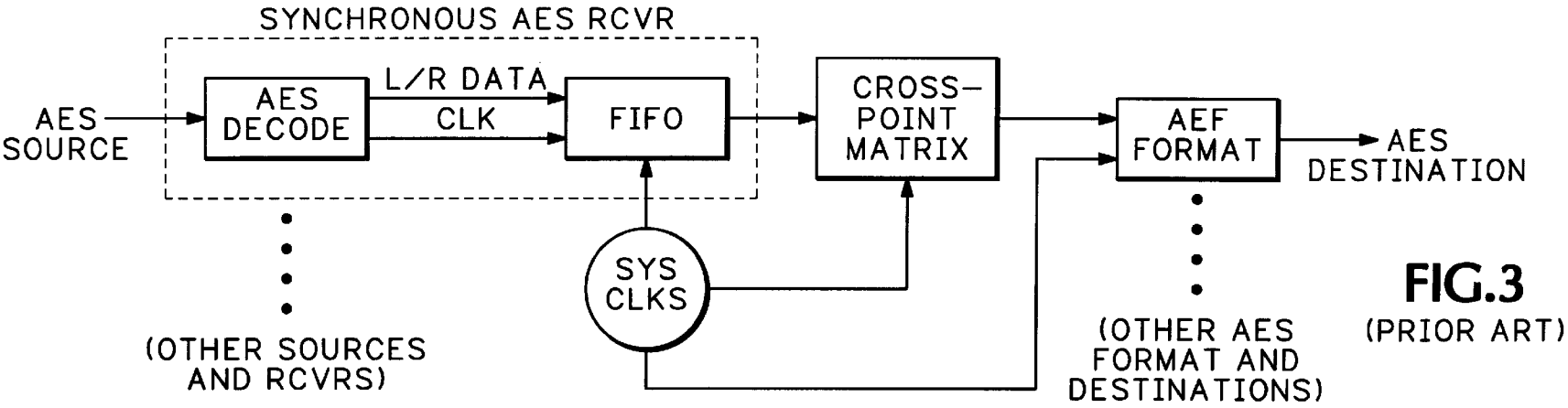
FIG.3 (PRIOR ART)
FIG. 3 is a block diagram view of a typical synchronous audio receiver at the input of a matrix according to the prior art.
Figure 4:
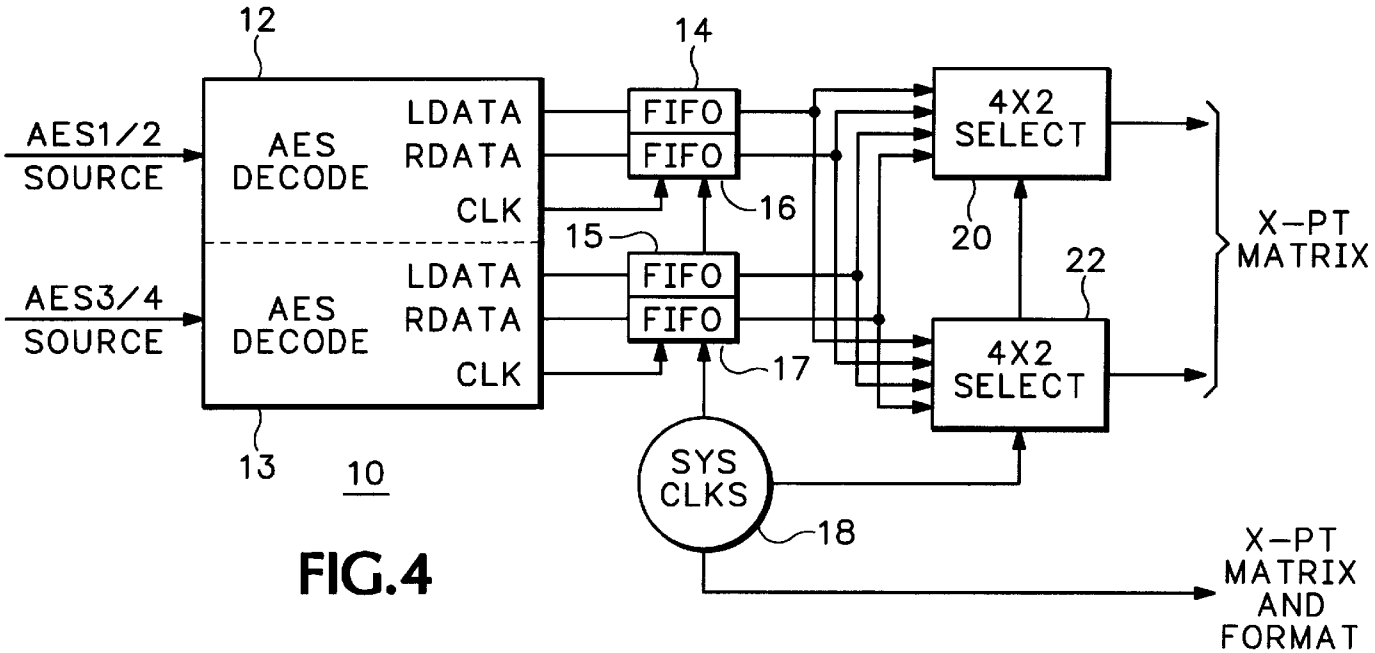
FIG. 4 is a block diagram view of a digital audio receiver with multichannel swapping capabilities according to the present invention.

Referring now to FIG. 4 a digital audio receiver 10 with multi-channel swapping capabilities receives two or more AES streams. Each AES stream goes through respective decoders 12, 13 which extract the respective clock and audio data (left and right channel samples). The extracted clocks are used to write the audio data from each AES stream to respective synchronizing FIFOs 14, 16, 15, 17. For this example there are four FIFOs 14, 16, 15, 17, one for each channel of audio data from the two AES streams shown. When the channel data are read out of the FIFOs 14, 16, 15, 17 under control of the system clocks 18, they are input to selectors 20, 22. The selectors 20, 22 assign the channel data from the FIFOs 14, 16, 15, 17 to either output stream and to either position within the selected output stream. The output streams from the receiver 10 are then input to a conventional matrix and formatted as shown in FIG. 3. The result is that input streams AES1/2 and AES3/4 may be read out as AES3/2 and AES 1/4 or any other combination depending upon a user's input to the selectors 20, 22. The receiver 10 may be implemented using digital logic, such as is found in a field-programmable gate array (FPGA).

Thus the present invention provides a digital audio receiver with multi-channel swapping capabilities by receiving at least two AES streams, breaking them into the component channels (left and right) and selecting at the output which two channels make up the at least two AES output streams for input to a conventional matrix in a router.

What is claimed is:

1. An audio apparatus with multi-channel swapping capability comprising:

means for decoding at least two serial digital audio data streams, each data stream having at least two channels of audio data, to produce a clock signal and separate channel audio data for each data stream;

means for individually storing the separate channel audio data under control of the respective clock signals; and means for selecting from the stored separate channel audio data a desired combination of the separate channel audio data to produce at least two output audio data streams, each having at least two channels of audio data.

2. The apparatus as recited in claim 1 further comprising means for directing the output audio data streams to desired destinations.

3. The apparatus as recited in claim 2 further comprising means for formatting the output audio data streams into serial digital audio data streams for output to the directed destinations.

4. A method of audio multi-channel swapping comprising the steps of:

decoding at least two serial digital audio data streams, each data stream having at least two channels of audio data, to produce a clock signal and separate channel audio data for each data stream;

individually storing the separate channel audio data under control of the respective clock signals; and selecting from the stored separate channel audio data a desired combination of the separate channel audio data to produce at least two output audio data streams, each having at least two channels of audio data.

5. The method as recited in claim 4 further comprising the step of directing the output audio data streams to desired destinations.

6. The method as recited in claim 5 further comprising the step of formatting the output audio data streams into serial digital audio data streams for output to the directed destinations.

7. An audio apparatus with multi-channel swapping capability comprising:

a decoder having at least two serial digital audio data streams as inputs, each data stream having at least two channels of audio data, and outputting a clock signal and separate channel audio data for each data stream;

a plurality of storage devices each having as an input a unique one of the separate channel audio data from the decoder, the unique one of the separate channel audio data being written into the storage devices under control of the respective one of the clock signals; and at least two selectors having as inputs from the storage devices the separate channel audio data and outputting at least two output audio data streams, each having at least two channels of audio data, representing a desired combination of the separate channel audio data.

8. The apparatus as recited in claim 7 further comprising a cross-point matrix having as inputs the output audio data streams from the selectors and outputting the output audio data streams to desired destinations.

9. The apparatus as recited in claim 8 further comprising a formatter having as an input one of the output audio data streams from the cross-point matrix and outputting a corresponding serial digital audio data stream for output to the directed destination.

* * * * *